US009631896B2

(12) United States Patent
Scroggins

(10) Patent No.: US 9,631,896 B2
(45) Date of Patent: Apr. 25, 2017

(54) PROJECTILE AIMING OPTICAL SYSTEM

(71) Applicant: C. Michael Scroggins, Richmond, TX (US)

(72) Inventor: C. Michael Scroggins, Richmond, TX (US)

( * ) Notice: Subject to any disclaimer, the term of this patent is extended or adjusted under 35 U.S.C. 154(b) by 496 days.

(21) Appl. No.: 13/678,526

(22) Filed: Nov. 15, 2012

(65) Prior Publication Data

US 2014/0130395 A1 May 15, 2014

(51) Int. Cl.

| | |
|---|---|
| ***G02B 23/00*** | (2006.01) |
| ***F41G 1/38*** | (2006.01) |
| ***F41G 1/467*** | (2006.01) |

(52) U.S. Cl.

CPC ..... *F41G 1/38* (2013.01); *F41G 1/467* (2013.01)

(58) Field of Classification Search

CPC ..... F41C 33/0254; F41C 23/04; F41G 1/38; F41G 1/467; F41G 3/06; F41G 3/08; F41G 1/473; F41G 3/165; F41G 1/345; F41G 3/12; F41G 1/30; F41G 1/40; F41G 3/142; F41G 11/00; F41G 1/00; F41G 1/35

USPC ..... 359/365–430, 505

See application file for complete search history.

(56) References Cited

U.S. PATENT DOCUMENTS

| | | | | |
|---|---|---|---|---|
| 2,094,623 | A | 10/1937 | Stokey | |
| 4,263,719 | A | 4/1981 | Murdoch | |
| 4,403,421 | A | 9/1983 | Shepherd | |
| 4,584,776 | A | 4/1986 | Shepherd | |
| 4,618,221 | A * | 10/1986 | Thomas | 359/428 |
| 5,671,724 | A | 9/1997 | Priebe | |
| 8,464,451 | B2 * | 6/2013 | McRae | 42/1.01 |
| 2006/0010760 | A1 * | 1/2006 | Perkins et al. | 42/142 |
| 2009/0199702 | A1 * | 8/2009 | Zaderey et al. | 89/41.17 |

OTHER PUBLICATIONS

Hind Sight Products website, http://www.hindsight.com/hindsightproducts.html, retrieved from the Internet on Feb. 22, 2013.

* cited by examiner

*Primary Examiner* — Scott J Sugarman
*Assistant Examiner* — Mustak Choudhury
(74) *Attorney, Agent, or Firm* — Forefront IP Lawgroup of Christie & Rivera, PLLC

(57) ABSTRACT

Described herein are technologies related to a weapon-mounted scope to facilitate an aiming of a projectile (e.g., bullet, arrow, etc.) towards an intended target.

19 Claims, 7 Drawing Sheets

PROJECTILE AIMING OPTICAL SYSTEM

BACKGROUND

A person typically uses an optical scope to improve the accuracy of rifles, bows, big guns, and other small arms in shooting a projectile to its intended target. For example, a hunter may mount an optical scope on his rifle to improve his accuracy when shooting a bullet towards some game or other intended target. A typical optical scope may include a crosshair that is in the focus of an eyepiece to aid in the aiming of the rifle.

The different designs for the optical scope may further require different numbers or designs of lenses. For example, if the hunter needs a pair of glasses to see the intended target clearly, then the optical scope may require multiple magnification lenses for this purpose. In another example, if the hunter needs to calculate the distance of the target to his current position, then the optical scope may be configured to calculate and provide the distance.

BRIEF DESCRIPTION OF THE DRAWINGS

The Detailed Description references the accompanying figures. In the figures, the left-most digit(s) of a reference number identifies the figure in which the reference number first appears. The same numbers are used throughout the drawings to reference like features and components.

DETAILED DESCRIPTION

Figure 1A:
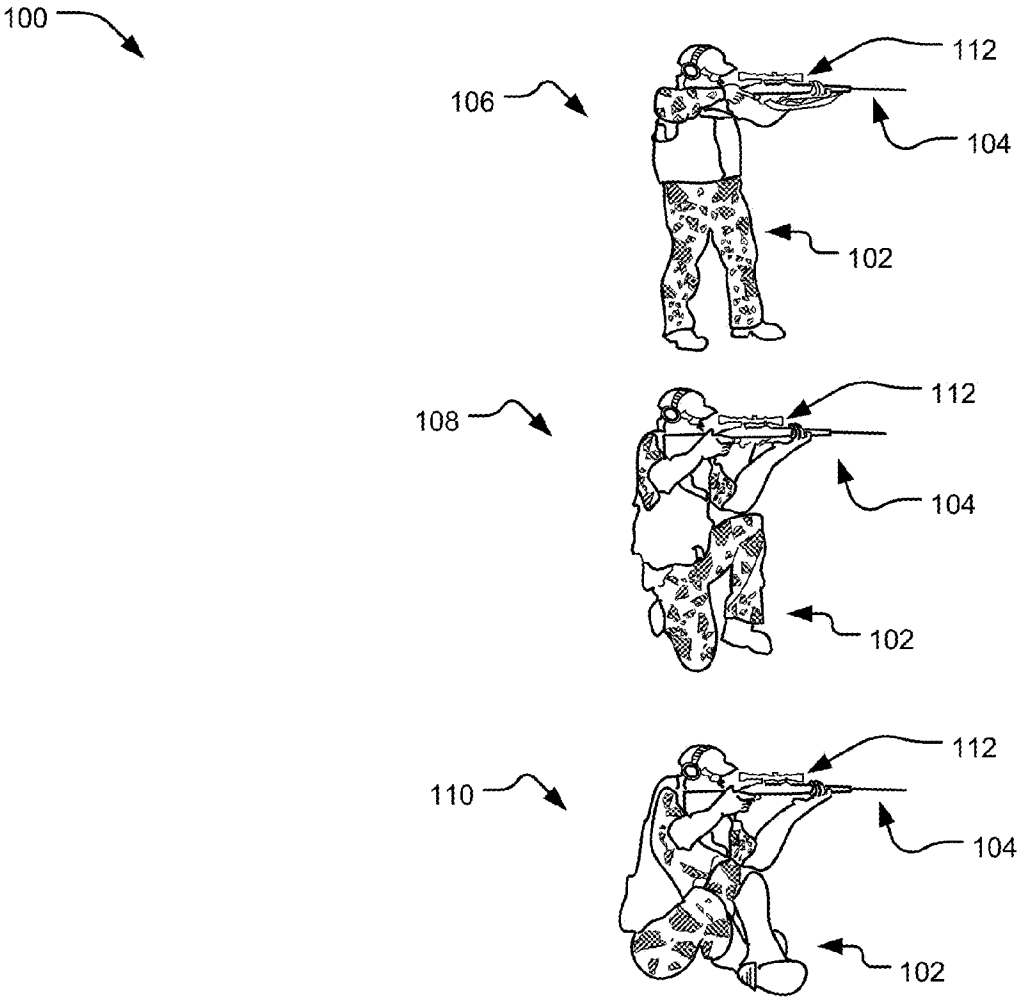
FIG. 1A illustrates a scenario that utilizes a scope in accordance with one or more implementations described herein.

Described herein is a technology for an optical system of a weapon-mounted scope that facilitates aiming of a projectile (e.g., bullet, arrow, etc.) to an intended target. More particularly, one or more of the described implementations of the optical system contain a stationary reticle and an adjustable reticle that are located between an objective lens and an eyepiece lens of the weapon-mounted scope. For example, upon calibration of the optical system, aligning centers of the stationary reticle and the adjustable reticle to the intended target, regardless of orientation in shooter's shooting position, allows the optical system to guide efficiently the projectile to hit the intended target. Furthermore, multiple calibrations of different yardages in the optical system allow the shooter to repeatedly align the stationary reticle to the adjustable reticle for the different yardages making the weapon, sight and shooter part of the same platform. For example, the platform increases accuracy and the accuracy is repeatable with every projectile fired.

Before the shooter utilizes the weapon-mounted scope for its intended purpose (e.g., hunting), the weapon-mounted scope is first calibrated to set a zero-in-adjustment. For example, the shooter installs a laser bore sight in a muzzle of his rifle to determine a projected point of impact of a projectile that comes out of the rifle. In this example, centers of the stationary reticle and the adjustable reticle are configured to align with the projected point of impact in order to set the zero-in-adjustment for the weapon-mounted scope. Since the stationary reticle has a fixed center, the configuration of the adjustable reticle may include its center to lie on an imaginary straight line that is defined by connecting the projected point of impact and the center of the stationary reticle.

After the initial calibration, the shooter may hit the same target all over again as long as the centers of the adjustable reticle and the stationary reticle align to an aiming point on the intended target. For example, if the aiming point is on a body of the intended target, then positioning of the centers of the adjustable reticle and the stationary reticle requires alignment with the body of the intended target. In this example, even though a different shooting position creates deviations in anchor points, the shooter will still hit the body of the intended target with high accuracy. Typical deviations in the anchor points are changes in elevation of shooter's head, different type of handgrip and/or hand placement, different position of shooter's cheeks on a butt of the rifle and/or along with the position of the butt's point of contact with the shoulder, and the like.

For bow-mounted bow sight optics, the same principle as discussed above may similarly apply although the adjustable reticle in the bow-mounted bow sight optics will vary depending upon which pin for a particular target yardage is used. For example, to calibrate a twenty-yard pin in a multiple-pin adjustable sight of the bow-mounted bow sight optics, a fiber optic range pin of the twenty-yard pin aligns with the projected point of impact and the center of the stationary reticle to set the zero-in-adjustment. After the calibration of the twenty-yard pin, the bow-mounted bow sight optics utilizes this twenty-yard pin to hit the aiming point on the intended target by aligning the center of the stationary reticle and a center point of the fiber optic range pin (i.e., twenty-yard pin) to the aiming point on the intended target.

After setting the zero-in-adjustment for the twenty-yard pin, the rest of the fiber optic range pins require calibration in the same fashion. For example, a second fiber optic range pin (i.e., thirty-yard pin) aligns with a thirty-yard projected point of impact and thirty-yard graduated crossbar of the stationary reticle. In another example, a third fiber optic range pin (i.e., forty-yard pin) aligns with a forty-yard projected point of impact and forty-yard graduated crossbar of the stationary reticle. In these examples, the graduated crossbars (e.g., one-over-eight inch size) overlay and align with a center point of a vertical alignment crossbar of the stationary reticle.

Example Scenario

FIG. 1A illustrates scenario 100 for different aiming positions by a shooter in shooting a rifle. The rifle mounts a scope that incorporates an implementation in accordance with the technology described herein. For example, the scope does not require separate calibration for each of the aiming positions even though different aiming positions define or create a different set of anchor points for the shooter. In this example, the set of anchor points refers to shooter's body positioning and configuration when holding the rifle in a particular aiming position.

The purpose of showing scenario 100 is to show that utilizing the scope in the illustrated implementation maintains accuracy of the scope in facilitating a projectile to hit an intended target (not shown). For example, after initial calibration of the scope in standing position, a change in shooting orientation, such as in a kneeling position or sitting position by the shooter does not affect the accuracy of the scope in the current implementation.

As depicted, scenario 100 shows a shooter 102 aiming a rifle 104 in standing position 106, kneeling position 108, and sitting position 110. Furthermore, scenario 100 depicts the rifle 104 with a mounted scope 112 that facilitates aiming of the projectile (e.g., bullet) from a firing system of the rifle 104 to the intended target. For example, the firing system of the rifle 104 includes a mechanism that discharges a loaded projectile towards the intended target.

During the initial calibration of the scope 112, corresponding anchor points will be adapted to maintain accuracy in a traditional scope; however, in the current implementation, deviations in anchor points have no effect on the accuracy of the calibrated scope 112 with multiple reticles (not shown). For example, when calibrating the scope 112 with the shooter 102 in the standing position 106, the anchor points refer to proper positioning of cheeks, amount of handgrip or hand placement, and/or head elevation of the shooter 102. In this example, a subsequent change to kneeling position 108, sitting position 110 or prone position (not shown) by the shooter 102 creates deviations from these anchor points. In other words, the deviations affect the accuracy of the traditional scope; however, in the current implementation, as long as the centers of the multiple reticles are in alignment with the intended target, then the deviations in the anchor points have no effect on the accuracy of the calibrated scope 112.

In other implementations, bows or crossbows may utilize the mounted scope 112. More particularly, the bows or crossbows adapt the calibration method of the multiple reticles in the scope 112.

Example Calibration

Figure 1B:
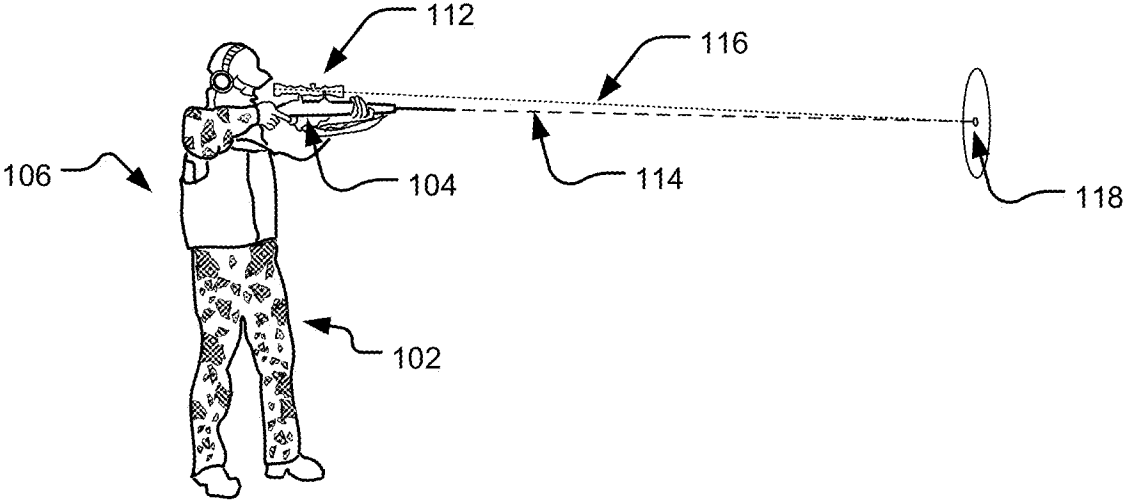
FIG. 1B illustrates an example calibration of a scope in accordance with one or more implementations described herein.

FIG. 1B illustrates an example calibration of the scope 112 in standing position 106. As depicted, FIG. 1B shows a projectile projection line 114, a zero-in-adjustment projection line 116, and a reference point 118.

Before the shooter 102 utilizes the mounted scope 112 to facilitate the aiming of the projectile from the firing system of the rifle 104, an initial calibration of the scope 112 creates a zero-in-adjustment on a sight of the rifle 104. For example, the initial calibration of the scope 112 requires formation of the reference point 118 that is an actual point of impact of a single shot or group shots from the rifle 104. In this example, bullet trajectories of the single shot or the group shots from the muzzle of the rifle 104 to the actual point of impact define the projectile projection line 114. In another example, the reference point 118 is a projected point of impact from an installed laser bore sight (not shown) at muzzle of the rifle 104. In this example, a laser light projects a line (e.g., infrared light) from the muzzle of the rifle 104 to the reference point 118 and defines the projectile projection line 114.

As an example of present implementations herein, aligning the centers of the multiple reticles of the scope 112 to the reference point 118 set the zero-in-adjustment of the rifle 104. For example, configuring the centers of the multiple reticles to be concentric with the reference point 118 defines the zero-in-adjustment projection line 116. In this example, the zero-in-adjustment projection line 116 is an imaginary straight line that contains the centers of the multiple reticles and the reference point as points that lie along the imaginary straight line.

After the initial calibration of the scope 112, directing the centers of the multiple reticles in the scope 112 to align with an aiming point on the intended target facilitates the bullet from rifle 104 to hit the aiming point on the intended target. This setting of the scope 112 after the initial calibration is the zero-in-adjustment of the scope 112.

As an example of present implementations herein, the zero-in-adjustment allows a sighted in weapon (e.g., rifle 104) to be shot with the same accuracy by multiple or different shooters 102 without recalibration. In other words, the required anchor point, which is the alignment of the fixed and adjustable reticles, remains the same whether the shooter 102 is aiming at kneeling position 108 or sitting position 110. To this end, the zero-in-adjustment will allow one rifle platform to be used with confidence by the multiple or different shooters 102.

Example Reticles

Figure 2:
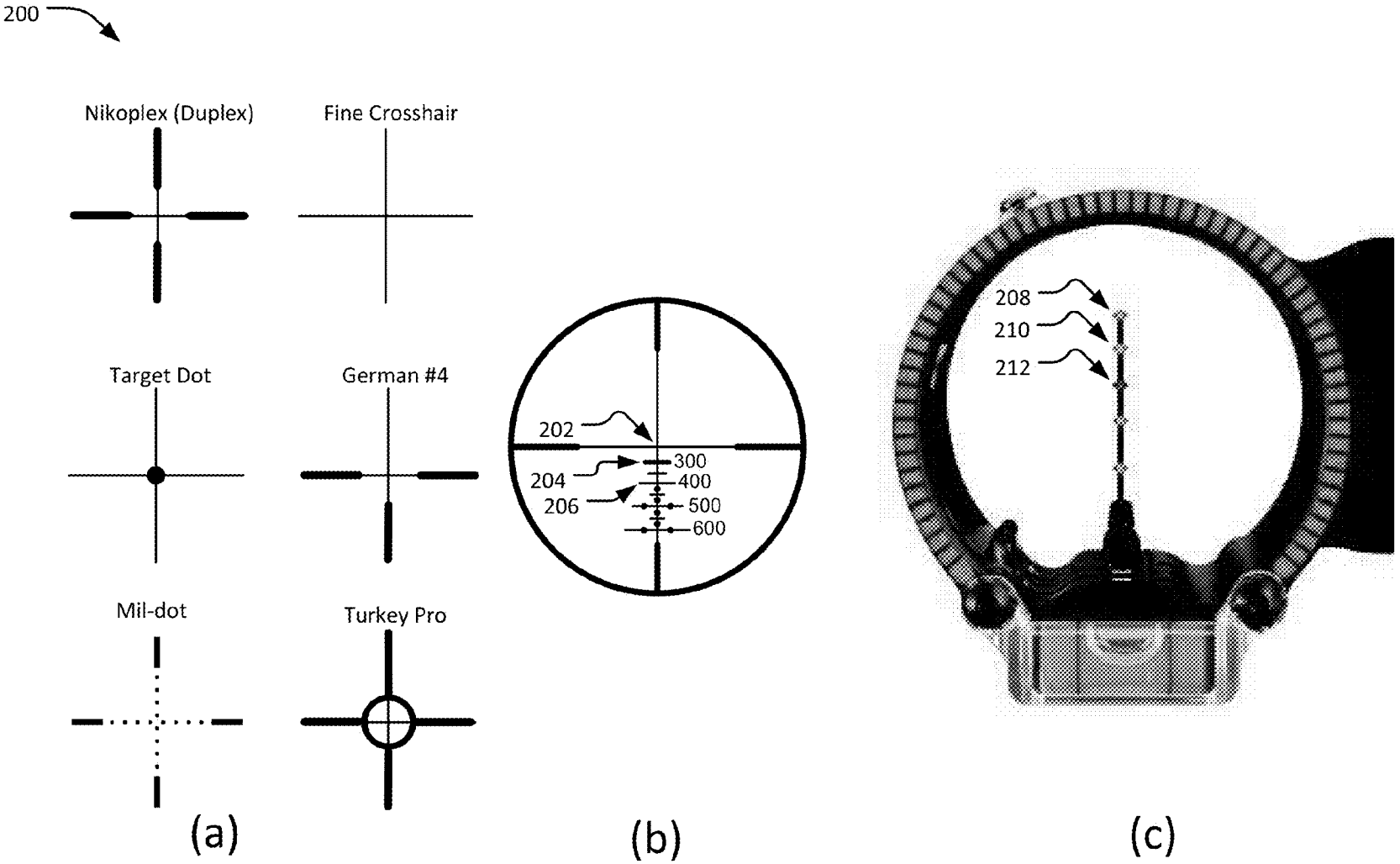
FIG. 2 illustrates example reticles of a scope in accordance with one or more implementations described herein.

FIG. 2 illustrates an example reticle 300 of the scope 112 in the current implementation. FIG. 2 shows some, but not all-inclusive, of different types of reticle application of the current implementation. For example, the multiple reticle implementations in the calibrated scope 112 contain additional stationary reticle (not shown) to create a static anchor point no matter what position the shooter 102 chooses to fire the projectile.

As shown, FIG. 2*a* shows different types of reticles to define a center of a field of view. For example, the different types of reticles may correspond to the reticle with a duplex, a fine crosshair, a target dot, a German, a Mildot, or a Turkey Pro. On the other hand, the field of view includes the extent of observable area when viewed through the scope 112. For example, viewing a particular deer among a herd of animals from the scope 112 provides surety of picking out certain animals from a field of vision view that includes the particular deer (or animal) rather than the herd of animals. In this example, chances of accidental taking of the wrong animal decreases due to the creation of anchor points and crosshair alignment.

FIG. 2*b* shows a reticle with different yardages on different graduated bars. For illustration purposes, FIG. 2*b* reticle illustrates a center point 202, a three-hundred yard point 204 in a second graduated bar, and a four-hundred yard point 206 in a third graduated bar. For example, if the intended target is within a range of zero to two hundred yards, then the scope 112 utilizes the center 202. In another example, if the intended target is within a range of three hundred or four hundred yards from the scope 112, then the scope 112 utilizes the three-hundred yard point 204 or four-hundred yard point 206, respectively.

FIG. 2*c* shows a reticle of a bow-mounted scope. For illustration purposes, FIG. 2*c* illustrates a center 208 for twenty-yard range, a thirty-yard point 210 for thirty-yard range, and a forty-yard point 212 for forty-yard range. For example, if the intended target is within a range of zero to twenty yards, then the bow-mounted scope utilizes the center 208. In another example, if the intended target is within a range of thirty or forty yards from the bow-mounted scope, then the bow-mounted scope utilizes the thirty-yard point 210 or forty-yard point 212, respectively.

As an example of current implementations herein, the combination of the fixed and the adjustable reticles increases the consistency of the shot pattern allowing accurate shots at longer distances. Furthermore, the stationary reticle serves a two-fold application. First, when aligning the stationary and adjustable reticle sights, a shooter's focus is on the alignment of two reticles and not on what is down range (e.g., target). Second, the fixed reticle and adjustable reticle serve as verification that the target acquisition when the fixed reticle blends into the field of the adjustable reticle. This action alone will increase accuracy and projectile placement with each shot fired.

Example Rifle with a Mounted Scope

Figure 3:
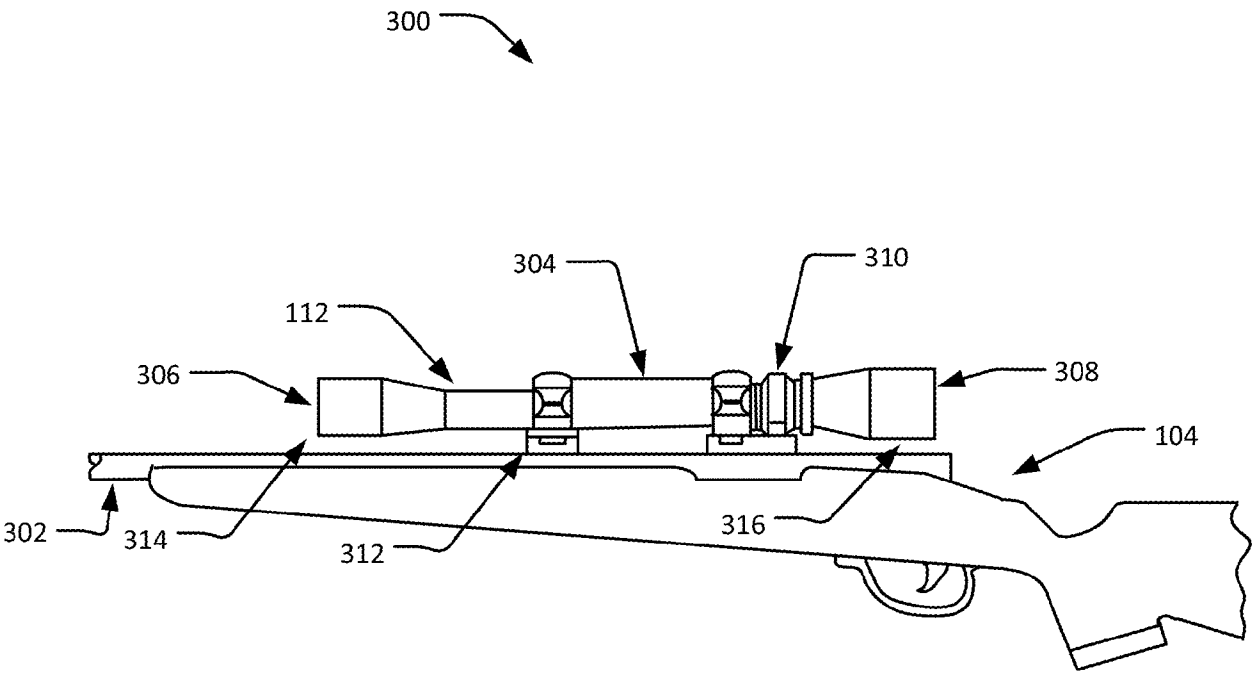
FIG. 3 illustrates an example side view of a rifle that mounts a scope in accordance with one or more implementations described herein.

FIG. 3 illustrates an example side view 300 of the rifle 104 with the mounted scope 112 on top of its barrel 302. The scope 112 illustrates an environment for the multiple reticles shown in FIGS. 4-5 according to present disclosure.

As shown, the side view 300 is a schematic diagram showing an arrangement of the scope 112 with a tubular housing 304, objective lens assembly 306, ocular lens assembly 308, power selector 310, and a scope base 312 to mount the scope 112 to the barrel 302.

As an example of one or more implementations described herein, the tubular housing 304 contains an elongated cylindrical plastic or metal tube to support the objective lens assembly 306 at front end 314 and the ocular lens assembly 308 at a rear end 316 of the scope 112. The tubular housing 304 includes an optical axis (not shown) that uses an imaginary straight line as a reference line for the alignment of the objective lens assembly 306, the ocular lens assembly 308, and other materials (e.g., stationary reticle, adjustable reticle, etc.) in an optical system of the scope 112. For example, the imaginary straight line extends from a center of the objective lens assembly 306 to a center of the ocular lens assembly 308 in an assembly of the tubular housing 304.

The objective lens assembly 306 typically contains two or three larger lenses (not shown) to form the objective lens assembly 306. The front end 314 of the tubular housing 304 houses these two or three larger lenses. They are referred to as objective lens assembly simply because they are closest to an object (e.g., target) being viewed as opposed to the ocular lens assembly 308 that is located at the rear end 316 of the tubular housing 304.

The ocular lens assembly 308 typically refers to eyepiece lens assembly because they are located nearest to the eye of the shooter 102. The eyepiece lens assembly contains lens to magnify further an image that the objective lens assembly 306 may receive and transfer to the ocular lens assembly 308. The tubular housing 304 contains an external thread where the ocular lens assembly 308 is set up for the scope 112.

With continuing reference to FIG. 3, the power selector 310 includes an adjustment of optical power of the scope 112 within a predetermined range of magnification. For example, a lower power is ideal at close range and for shooting moving targets. The low power provides an effective light management to produce brighter sight picture of the target even in low-light conditions. In another example, a high power is ideal for target shooting such as when the target is located at a particular fix area.

Example Optical System

Figure 4:
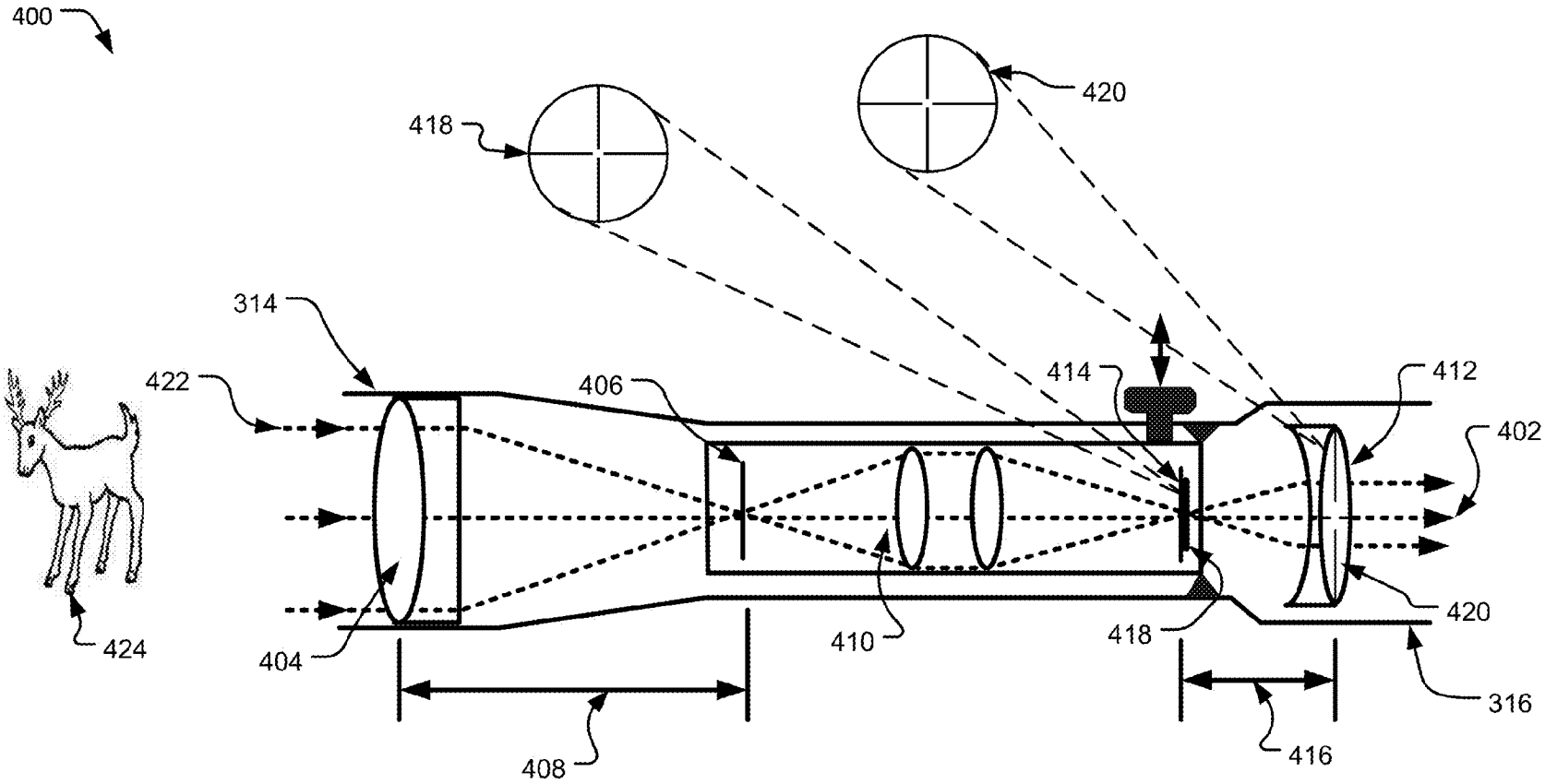
FIG. 4 illustrates an optical system, in accordance with one or more implementations described herein, that shows internal parts and configuration of a scope.

FIG. 4 illustrates an optical system 400 that shows internal parts and configuration of the scope 112. As shown, the optical system 400 with an optical axis 402 contains an objective lens 404, a front focal plane 406, a front focal length 408, erector lens 410, an eyepiece lens 412, a rear focal plane 414, a rear focal length 416, an adjustable reticle 418, and a stationary reticle 420. Furthermore, the optical system 400 shows light rays 422 that contain light reflections from a deer 424 to the objective lens 404. For example, the light rays 422 penetrate within a diameter of the objective lens 404 of the scope 112.

As depicted, positioning of the objective lens 404, front focal plane 406, erector lens 410, rear focal plane 414, and the eyepiece lens 412 is from the front end 314 to the rear end 316 of the scope 212. They are parallel with one another and their respective center points are laying in the optical axis 402. For example, the front focal plane 406 and the rear focal plane 414 are disposed next to the objective lens 404 and the eyepiece lens 412, respectively. In this example, the front focal plane 406 is disposed at the distance of front focal length 406 from the objective lens 404 while the rear focal plane 406 is disposed at the distance of rear focal length 416 from the eyepiece lens 412. On the other hand, the erector lens is disposed between the front focal plane 406 and the rear focal plane 414.

As shown, the objective lens 404 receives the light rays 422 that represent an image of the deer 424. For example, the deer 424 bounces or reflects the light rays 422 straight to the scope 112 when the shooter 102 aims his rifle 104 at the direction of the deer 424. In this example, the objective lens 404 focuses the light rays 422 to the front focal plane 406.

As an example of present implementations herein, the front focal plane 406 receives the light rays 422 that flow from the front end 314 to the rear end 316. In this example, the light rays 422 exit the front focal plane 406 at an inverted direction. For example, the light rays 422 enter the front focal plane 406 above the optical axis 402 and exit the front focal plane 406 below the optical axis 402.

As shown, the erector lens 410 receives the light rays 422 from the front focal plane 406 and inverts the orientation or direction of the light rays 422. For example, the light rays 422 exit the front focal plane 406 at a particular angle (e.g., thirty degrees) below the optical axis 402 and into the direction of the erector lens 410. In this example, the erector lens 410 receives and inverts the angle of the light rays 422 back to upward direction (e.g., thirty degrees) above the optical axis 402. In other words, the erector lens 410 transfers the light rays 422 from the output of the front focal plane 406 by changing the angle going into the rear focal plane 414.

As an example of present implementations herein, the rear focal plane 414 receives and converges the light rays 422. For example, the re-inverted light rays 422 from the erector lens 410 are entering through the center of the rear focal plane 414. In this example, the rear focal plane 414 transfers and refocuses the light rays 422 to create visibility of the image at the eyepiece lens 412.

Typically, the light rays 422 that pass through the eyepiece lens 412 represent a magnified image of the deer 424. For example, adjustments of the rear focal length 416 and/or positions of the erector lens 410 create the magnified image. In this example, the eyepiece lens 412 is configured to be adjustable to change the distance in the rear focal length 416.

As an example of the one or more implementations described herein, the adjustable reticle 418 is disposed along the rear focal plane 414 while the stationary reticle 420 overlays concentrically with the eyepiece lens 412. For example, aligning the centers of the adjustable reticle 418 and the stationary reticle 420 with the reference point 118 in FIG. 1B calibrates the optical system 400. Since the stationary reticle 420 has a fixed center, configuring the center of the adjustable reticle 418 to coincide or align with the center of the stationary reticle 420 and the reference point 118 creates the zero-in-adjustment. For example, configuring the center of the adjustable reticle 418 includes adjusting the center of the adjustable reticle 418 to lie on converged light rays 422 at the rear focal plane 414. In this example, the centers of the adjustable reticle 418 and the stationary reticle 420 lie on the zero-in-adjustment projection line 116 in FIG. 1B.

After setting the zero-in-adjustment for the optical system 400, aligning the centers of the adjustable reticle 418 and the stationary reticle 420 to the deer 424 facilitates the projectile to discharge towards the deer 424 regardless of the shooting position of the shooter 102. For example, as long as the center of the stationary reticle 420 coincides with the center of the adjustable reticle 418 and the aiming point on the deer 424, the shooter 102 will be able to hit the deer 424. In this example, the shooter 102 aims the rifle 104 in standing position 106, kneeling position 108, sitting position 110, or in the prone position.

In another implementation, the adjustable reticle 418 coincides with the front focal plane 406 that is disposed at the distance of front focal length 408 from the objective lens 404. In this example, increasing power in the power selector 410 magnifies the deer 424 and the adjustable reticle 418 at the same time. As opposed to placing the adjustable reticle 418 in the rear focal plane 414, adjustment of the power selector 410 changes the image of the deer 424 but not the size of the adjustable reticle 418. On the other hand, since the stationary reticle 420 is fixed (i.e., static), the size of the stationary reticle 420 is the same no matter how the magnification has been adjusted.

Bow-Mounted Bow Sight

Figure 5:
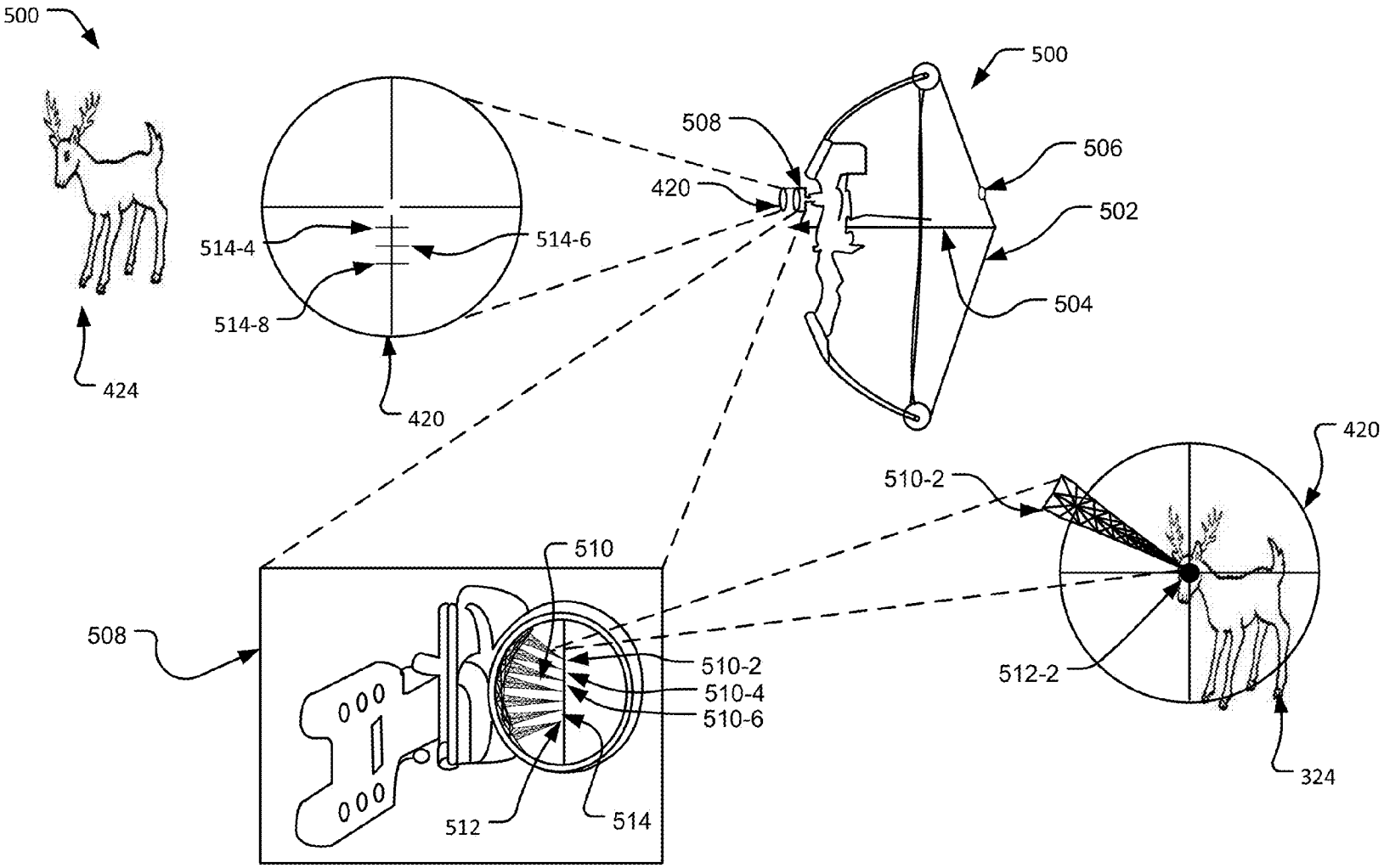
FIG. 5 illustrates a structure of a bow that utilizes a stationary reticle in accordance with one or more implementations described herein.
Figure 6:
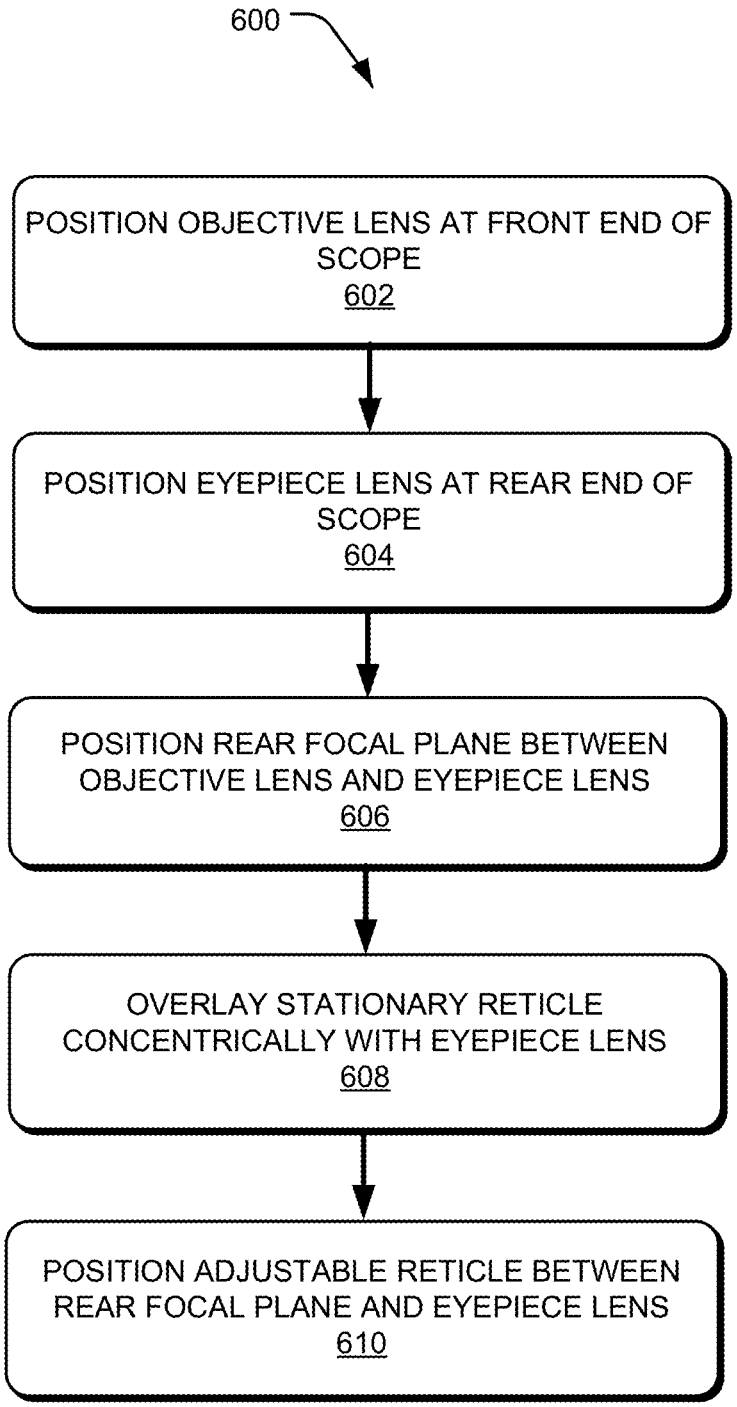
FIG. 6 is an example method for manufacturing a sight in accordance with one or more implementations described herein.

FIG. 5 illustrates a structure 500 showing a bow with a bow-mounted bow sight that facilitates aiming and discharging of the projectile (e.g., arrow) to the intended target. As shown, the structure 500 contains a bow string 502, an arrow projectile 504, and the bow-mounted bow sight that includes a peep sight 506, the stationary reticle 420, and multiple-pin adjustable sight 508 that is located between the stationary reticle 420 and the peep sight 506. Furthermore, the multiple-pin adjustable sight 508 has fiber optic pins 510 with corresponding pin tips 512 for different yardages, and a vertical line 514 that passes through the pin tips 512. The fiber optic pins 510, for example, include twenty-yard pin 510-2 with pin tip 512-2, thirty-yard pin 510-4 with pin tip 512-4, and forty-yard pin 510-6 with pin tip 512-6.

As an example of present implementations herein, the stationary reticle 420 contains a less than quarter inches size graduated crossbars 514 that align with the center point of a vertical alignment in the stationary reticle 420. For example, the graduated crossbars 514 include, for example, a thirty-yard graduated crossbar 514-4, forty-yard graduated crossbar 514-6, fifty-yard graduated crossbar 514-6, etc. In this example, the stationary reticle 420 is disposed at a front or external end of the multiple-pin adjustable sight 508.

Similar to the rifle-mounted scope 112 in FIG. 1B, a calibration of the bow-mounted bow sight sets its zero-in-adjustment. For example, for a particular target range (e.g., twenty-yards target distance), releasing the arrow projectile 504 creates the reference point 118. In this example, aligning the center of stationary reticle 420 and the pin tip 512-2 of the twenty-yard pin 510-2 to the reference point 118 set the zero-in-adjustment of the bow-mounted bow sight. However, this zero-in-adjustment is limited to the twenty-yard pin 510-2 of the multiple-pin adjustable sight 508. In other words, the zero-in-adjustment does not include the rest of the fiber optic pins 510 such as the thirty-yard pin 510-4, forty-yard pin 510-6, etc. in the multiple-pin adjustable sight 508.

After zeroing-in the twenty-yard pin 510-2, the calibration of the thirty-yard pin 510-4 requires alignment of the pin tip 512-4 with the thirty-yard graduated crossbar 514-4 and the reference point 118 at thirty-yard range. Similarly, the calibration of the rest of the fiber optic pins 510 follows the zero-in-adjustment as discussed above for the twenty-yard pin 510-2 and the thirty-yard pin 510-4.

As another example of present implementations herein, a single post fiber optic bow sight (not shown) adapts the principle as discussed above. More particularly, instead of aligning several pins 510 to the graduated crossbars 514, a worm gear single adjustment sets the fiber optic pins at different yardages and the particular yardage will be marked on a thumbwheel on this type of bow sight.

After the calibration of the bow-mounted bow sight, directing the pin tip 512 (e.g., pin tip 512-2) of the pin 510 (e.g., pin 510-2) to coincide with the center of the stationary reticle 420 and an aiming point on the intended target (e.g., deer 424) facilitates the arrow projectile 504 to hit the deer 424. This is regardless of shooting position that the archer is using (e.g., standing position 106, kneeling position 108, or sitting position 110).

With continuing reference to FIG. 5, the peep sight 506 attaches to the bow string 502 such that at a drawn out position, the peep sight 506 aligns with an outer edge of the multiple-pin adjustable sight 508 and the stationary reticle 420.

In other implementations, the stationary reticle 420 overlays on a magnifying lens at an external face or front end of the multiple-pin adjustable sight 508.

Furthermore, the same procedure applies to the single post fiber optic pins for sighting in the crossbow (not shown). For example, the crossbow is a rifle that mounts the bow on top as its barrel. In this example, the calibration of the single post fiber optic pins adapts the calibration of the structure 500 described above.

Example Method of Sight Manufacturing

FIG. 5 shows an example flowchart 500 illustrating an example method of manufacturing a sight that facilitates aiming of a projectile (e.g., bullet, arrow, etc.) to an intended target. The order in which the method is described is not intended to be construed as a limitation, and any number of the described method blocks can be combined in any order to implement the method, or alternate method. Additionally, individual blocks may be deleted from the method without departing from the spirit and scope of the subject matter described herein.

At block 502, an optical system is assembled by positioning an objective lens at front end of a scope. For example, the objective lens 304 is disposed at the front end 314 of optical assembly 300.

At block 504, the optical system assembly includes positioning of an eyepiece lens at rear end of the scope. For example, the eyepiece lens 312 is disposed at the rear end 316 of the optical assembly 300.

At block 506, the optical system assembly includes positioning of a rear focal plane between the objective lens and the eyepiece lens.

At block 508, the optical system assembly includes overlaying concentrically a stationary reticle along the eyepiece lens. For example, the stationary reticle 420 overlays concentrically on the eyepiece lens 312. In this example, the center of the stationary reticle 420 aligns with the center of the eyepiece lens 312.

As an example of present implementations herein, the stationary reticle 420 in a bow-mounted bow sight contains graduated crossbars 514 for different yardages.

At block 510, the optical system assembly includes positioning of an adjustable reticle between the rear focal plane and the eyepiece lens. For example, the adjustable reticle 318 is disposed along the rear focal plane 314 of the optical system 300. In this example, adjusting a center of the adjustable reticle 318 to coincide with the reference point 118 and the center of the stationary reticle provides the initial calibration of the scope. Thereafter, a shooter (e.g., shooter 102) utilizes the calibrated scope (e.g., scope 112) to facilitate aiming of the projectile to hit a desired target (e.g., target 324) regardless of shooting position (e.g., standing position 106, kneeling position 108, or sitting position 110) of the shooter 102.

As an example of one or more implementations described herein, as long as the centers of the stationary reticle 420 and the adjustable reticle 318 of the calibrated scope 112 are aligned with the desired target, an accuracy to hit the desired target is maintained. In this example, any deviations in anchor points due to change in shooting or aiming position of the shooter 102 do not affect this accuracy.

Additional and Alternative Implementation Notes

In the above description of example implementations, for purposes of explanation, specific numbers, materials configurations, and other details are set forth in order to better explain the present invention, as claimed. However, it will be apparent to one skilled in the art that the claimed invention may be practiced using different details than the example ones described herein. In other instances, well-known features are omitted or simplified to clarify the description of the example implementations.

The inventor intends the described example implementations to be primarily examples. The inventor does not intend these example implementations to limit the scope of the appended claims. Rather, the inventor has contemplated that the claimed invention might also be embodied and implemented in other ways, in conjunction with other present or future technologies.

Moreover, the word "example" is used herein to mean serving as an example, instance, or illustration. Any aspect or design described herein as "example" is not necessarily to be construed as preferred or advantageous over other aspects or designs. Rather, use of the word example is intended to present concepts and techniques in a concrete fashion. The term "techniques," for instance, may refer to one or more devices, apparatuses, systems, methods, articles of manufacture, and/or computer-readable instructions as indicated by the context described herein.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

These processes are illustrated as a collection of blocks in a logical flow graph, which represents a sequence of operations that can be implemented in mechanics alone or a combination with hardware, software, and/or firmware. In the context of software/firmware, the blocks represent instructions stored on one or more computer-readable storage media that, when executed by one or more processors, perform the recited operations.

Note that the order in which the processes are described is not intended to be construed as a limitation, and any number of the described process blocks can be combined in any order to implement the processes or an alternate process. Additionally, individual blocks may be deleted from the processes without departing from the spirit and scope of the subject matter described herein.

The term "computer-readable media" includes computer-storage media. For example, computer-storage media may include, but are not limited to, magnetic storage devices (e.g., hard disk, floppy disk, and magnetic strips), optical disks (e.g., compact disk (CD) and digital versatile disk (DVD)), smart cards, flash memory devices (e.g., thumb drive, stick, key drive, and SD cards), and volatile and non-volatile memory (e.g., random access memory (RAM), read-only memory (ROM)).

Unless the context indicates otherwise, the term "logic" used herein includes hardware, software, firmware, circuitry, logic circuitry, integrated circuitry, other electronic components and/or a combination thereof that is suitable to perform the functions described for that logic.

In the claims appended herein, the inventor invokes 35 U.S.C. §112, paragraph 6 only when the words "means for" or "steps for" are used in the claim. If such words are not used in a claim, then the inventor does not intend for the claim to be construed to cover the corresponding structure, material, or acts described herein (and equivalents thereof) in accordance with 35 U.S.C. §112, paragraph 6.

The invention claimed is:

1. An optical system that facilitates aiming of a projectile, the optical system comprising:

an objective lens that is configured to receive and guide light rays to a front focal plane, wherein a distance of the objective lens to the front focal plane is defined by a front focal length;

a rear focal plane that is configured to receive converged light rays through a center of the rear focal plane, the rear focal plane is disposed at a rear focal length from an eyepiece lens, wherein the rear focal length facilitates transfer and refocusing of the converged light rays from the center of the rear focal plane to the eyepiece;

an erector lens located between the front and the rear focal planes, the erector lens is configured to transfer the received light rays from the front focal plane to the rear focal plane, wherein the transferring of the received light rays includes changing inverted angles of the received light rays into converged light rays that is received through the center of the rear focal plane;

an adjustable reticle disposed to coincide with the rear focal plane, the adjustable reticle includes a center that is adjusted to lie on the converged light rays at the center of the rear focal plane, wherein a calibration of the optical system includes aligning the center of the adjustable reticle to lie on an optical axis of the optical system;

a stationary reticle disposed at the eyepiece lens, wherein the stationary reticle, objective lens, erector lens, and the eyepiece lens are disposed concentrically with one another, wherein each center of the stationary reticle, objective lens, erector lens, and the eyepiece lens lie at the optical axis of the optical system, wherein the calibration of the optical system places the center of the adjustable reticle to be concentric with the centers of the stationary reticle, objective lens, erector lens, and the eyepiece lens.

2. An optical system as recited in claim 1, wherein the transferred and refocused converged light rays received by the eyepiece lens represent a magnified image of a target.

3. An optical system as recited in claim 1, wherein the optical axis passes through centers of the front focal plane and the rear focal plane.

4. An optical system as recited in claim 1, wherein the eyepiece lens is configured to be adjustable to change the distance of the rear focal length.

5. A gun sight comprising:

a scope base;

a tubular housing that is attached to the scope base, wherein the tubular housing includes an optical system as recited in claim 1.

6. A gun comprising:

a firing system configured to discharge the projectile from the gun;

a scope that includes an optical system as recited in claim 1.

7. A weapon-mounted scope comprising:

an objective lens disposed at a front end of the scope, the objective lens configured to receive and guide light rays to a front focal plane;

a rear focal plane that is configured to receive converged light rays through a center of the rear focal plane, the rear focal plane is disposed at a rear focal length from an eyepiece lens, wherein the rear focal length facilitates transfer and refocusing of the converged light rays from the center of the rear focal plane to the eyepiece lens an erector lens located between the front and the rear focal planes, the erector lens is configured to change inverted angles of the received light rays into converged light rays that is received through the center of the rear focal plane;

a stationary reticle disposed to overlay on the eyepiece lens, the stationary reticle, objective lens, erector lens, and the eyepiece lens are disposed concentrically with one another, wherein each center of the stationary reticle, objective lens, erector lens, and the eyepiece lens lie at an optical axis of the scope;

an adjustable reticle disposed to coincide with the rear focal plane, a center of the adjustable reticle being configured to lie on the converged light rays at the center of the rear focal plane, wherein a calibration of the scope includes aligning the center of the adjustable reticle to lie on the optical axis and to be concentric with each center of the stationary reticle, objective lens, erector lens, and the eyepiece lens.

8. A scope as recited in claim 7, wherein the optical axis is represented by an imaginary line that connects the centers of the stationary lens, objective lens, erector lens, and the eyepiece lens.

9. A scope as recited in claim 7, wherein the eyepiece lens is configured to be adjustable to change a distance of a rear focal length.

10. A gun sight comprising:

a scope base;

a scope as recited in claim 7.

11. A gun comprising:

a firing system that discharges a projectile from the gun;

a scope as recited in claim 7.

12. A method of manufacturing a sight, the method comprising:

positioning an objective lens at a front end of a scope;

positioning an eyepiece lens at a rear end of the scope;

positioning a rear focal plane between the objective lens and the eyepiece lens, wherein the rear focal plane is disposed at a rear focal length from the eyepiece lens;

overlaying concentrically a stationary reticle at the eyepiece lens of the scope;

disposing an adjustable reticle to coincide with the rear focal plane, the adjustable reticle includes a center that is adjusted to lie on the converged light rays at the center of the rear focal plane;

inserting an erector lens that is disposed between the objective lens and the rear focal plane, the erector lens is configured to change inverted angles of the received light rays into converged light rays that is received through the center of the rear focal plane.

13. A method as recited in claim 12, wherein the objective lens is receiving light rays of a target image, the received light rays are transferred and converged to the center of the rear focal plane.

14. A method as recited in claim 12, wherein the centers of the objective lens, stationary reticle, rear focal plane, and the eyepiece lens lie at an optical axis.

15. A method as recited in claim 12 further comprising building a scope base that is attached to a tubular housing of the scope.

16. A method as recited in claim 12, wherein the rear focal length defines a distance between the adjustable reticle and the stationary reticle.

17. A method as recited in claim 12 further comprising: configuring the eyepiece lens to be adjustable to change the rear focal length.

18. A method as recited in claim 12 further comprising:

positioning a front focal plane between the objective lens and the rear focal plane.

19. A method as recited in claim 18, wherein the front focal plane is disposed at a front focal length from the objective lens.

* * * * *